US005840411A

United States Patent [19]

Stelljes, Jr. et al.

[11] Patent Number: 5,840,411

[45] **Date of Patent: *Nov. 24, 1998**

[54] MULTIPLE LAYER PAPERMAKING BELT PROVIDING IMPROVED FIBER SUPPORT FOR CELLULOSIC FIBROUS STRUCTURES, AND CELLULOSIC FIBROUS STRUCTURES PRODUCED THEREBY

[75] Inventors: Michael Gomer Stelljes, Jr., West Chester; Glenn David Boutilier, Cincinnati; Paul Dennis Trokhan, Hamilton, all of Ohio

[73] Assignee: The Procter & Gamble Company, Cincinnati, Ohio

[ * ] Notice: The term of this patent shall not extend beyond the expiration date of Pat. No. 5,496,624.

[21] Appl. No.: 575,308

[22] Filed: Dec. 20, 1995

Related U.S. Application Data

[63] Continuation of Ser. No. 254,387, Jun. 2, 1994, Pat. No. 5,496,624.

[51] Int. Cl.[6] ..... D03D 3/00

[52] U.S. Cl. ..... 428/229; 139/383 A; 428/225; 428/131; 428/135; 428/137; 428/246; 428/247

[58] Field of Search ..... 428/229, 131, 428/135, 137, 225, 246, 247; 139/383 A

[56] References Cited

U.S. PATENT DOCUMENTS

| | | | |
|---|---|---|---|
| 4,821,780 | 4/1989 | Tate | 139/383 A |
| 4,921,750 | 5/1990 | Todd | 428/225 |
| 4,941,514 | 7/1990 | Taipale | 139/383 A |
| 4,967,805 | 11/1990 | Chiu et al. | 139/383 A |
| 4,995,429 | 2/1991 | Kositzke | 139/383 R |
| 5,074,339 | 12/1991 | Vohringer | 139/383 A |
| 5,101,866 | 4/1992 | Quigley | 139/383 A |
| 5,114,777 | 5/1992 | Gaisser | 428/137 |
| 5,496,624 | 3/1996 | Stelljes et al. | 428/229 |

FOREIGN PATENT DOCUMENTS

| | | |
|---|---|---|
| 86110746.4 | 4/1986 | European Pat. Off. . |
| WO 89/09848 | 10/1989 | WIPO . |
| WO 91/14813 | 10/1991 | WIPO . |

*Primary Examiner*—James J. Bell

*Attorney, Agent, or Firm*—Larry L. Huston; E. Kelly Linman; Jacobus C. Rasser

[57] ABSTRACT

A papermaking belt, comprising either a forming wire or a through-air-drying belt. The papermaking belt comprises a reinforcing structure having two layers tied together and a resinous framework. The yarns of the first layer are interwoven so that, except for the tie yarns, each yarn remains within 1.5 yarn diameters of the top plane defined by the knuckles of the first layer. The belt has a thickness of at least 2.5 times the yarn diameter for rigidity.

19 Claims, 4 Drawing Sheets

MULTIPLE LAYER PAPERMAKING BELT PROVIDING IMPROVED FIBER SUPPORT FOR CELLULOSIC FIBROUS STRUCTURES, AND CELLULOSIC FIBROUS STRUCTURES PRODUCED THEREBY

This is a continuation of application Ser. No. 08/254,387, filed Jun. 2, 1994, now U.S. Pat. No. 5,496,624.

FIELD OF THE INVENTION

The present invention relates to papermaking, and more particularly to belts used in papermaking. Such belts reduce non-uniform fiber distribution and/or pinholes and other irregularities indigenous to molding fibers into a three dimensional belt.

BACKGROUND OF THE INVENTION

Cellulosic fibrous structures, such as paper towels, facial tissues, and toilet tissues, are a staple of every day life. The large demand and constant usage for such consumer products has created a demand for improved versions of these products and, likewise, improvement in the methods of their manufacture. Such cellulosic fibrous structures are manufactured by depositing an aqueous slurry from a headbox onto a Fourdrinier wire or a twin wire paper machine. Either such forming wire is an endless belt through which initial dewatering occurs and fiber rearrangement takes place. Frequently, fiber loss occurs due to fibers flowing through the forming wire along with the liquid carrier from the headbox.

After the initial formation of the web, which later becomes the cellulosic fibrous structure the papermaking machine transports the web to the dry end of the machine. In the dry end of a conventional machine, a press felt compacts the web into a single region cellulosic fibrous structure prior to final drying. The final drying is usually accomplished by a heated drum, such as a Yankee drying drum.

One of the significant aforementioned improvements to the manufacturing process, which yields a significant improvement in the resulting consumer products, is the use of through-air drying to replace conventional press felt dewatering. In through-air drying, like press felt drying, the web begins on a forming wire which receives an aqueous slurry of less than one percent consistency (the weight percentage of fibers in the aqueous slurry) from a headbox. Initial dewatering takes place on the forming wire, but the forming wire is not usually exposed to web consistencies of greater than 30 percent. From the forming wire, the web is transferred to an air pervious through air drying belt.

Air passes through the web and the through-air-drying belt to continue the dewatering process. The air passing the through-air-drying belt and the web is driven by vacuum transfer slots, other vacuum boxes or shoes, predryer rolls, etc. This air molds the web to the topography of the through-air-drying belt and increases the consistency of the web. Such molding creates a more three dimensional web, but also creates pinholes if the fibers are deflected so far in the third dimension that a breach in fiber continuity occurs.

The web is then transported to the final drying stage where the web is also imprinted. At the final drying stage, the through air drying belt transfers the web to a heated drum, such as a Yankee drying drum for final drying. During this transfer, portions of the web are densified during imprinting to yield a multi-region structure. Many such multi-region structures have been widely accepted as preferred consumer products. An example of an early through-air-drying belt which achieved great commercial success is described in U.S. Pat. No. 3,301,746, issued Jan. 31, 1967 to Sanford et al.

Over time, further improvements became necessary. A significant improvement in through-air-drying belts is the use of a resinous framework on a reinforcing structure. This arrangement allows drying belts to impart continuous patterns, or, patterns in,any desired form, rather than only the discrete patterns achievable by the woven belts of the prior art. Examples of such belts and the cellulosic fibrous structures made thereby can be found in U.S. Pat. Nos. 4,514,345, issued Apr. 30, 1985 to Johnson et al.; 4,528,239, issued Jul. 9, 1985 to Trokhan; 4,529,480, issued Jul. 16, 1985 to Trokhan; and 4,637,859, issued Jan. 20, 1987 to Trokhan. The foregoing four patents are incorporated herein by reference for the purpose of showing preferred constructions of patterned resinous framework and reinforcing type through-air-drying belts, and the products made thereon. Such belts have been used to produce extremely commercially successful products such as Bounty paper towels and Charmin Ultra toilet tissue, both produced and sold by the instant assignee.

As noted above, such through-air-drying belts used a reinforcing element to stabilize the resin. The reinforcing element also controlled the deflection of the papermaking fibers resulting from vacuum applied to the backside of the belt and airflow through the belt. The early belts of this type used a fine mesh reinforcing element, typically having approximately fifty machine direction and fifty cross-machine direction yarns per inch. While such a fine mesh was acceptable from the standpoint of controlling fiber deflection into the belt, it was unable to stand the environment of a typical papermaking machine. For example, such a belt was so flexible that destructive folds and creases often occurred. The fine yarns did not provide adequate seam strength and would often burn at the high temperatures encountered in papermaking.

Yet other drawbacks were noted in the early embodiments of this type of through-air-drying belt. For example, the continuous pattern used to produce the consumer preferred product did not allow leakage through the backside of the belt. In fact, such leakage was minimized by the necessity to securely lock the resinous pattern onto the reinforcing structure. Unfortunately, when the lock-on of the resin to the reinforcing structure was maximized, the short rise time over which the differential pressure was applied to an individual region of fibers during the application of vacuum often pulled the fibers through the reinforcing element, resulting in process hygiene problems and product acceptance problems, such as pinholes.

A new generation of patterned resinous framework and reinforcing structure through-air-drying belts addressed some of these issues. This generation utilized a dual layer reinforcing structure having vertically stacked machine direction yarns. A single cross-machine direction yarn system tied the two machine direction yarns together.

For paper toweling, a relatively coarse mesh, such as thirty-five machine direction yarns and thirty cross-machine direction yarns per inch, dual layer design significantly improved the seam strength and creasing problems. The dual layer design also allowed some backside leakage to occur. Such allowance was caused by using less precure energy in joining the resin to the reinforcing structure, resulting in a compromise between the desired backside leakage and the ability to lock the resin onto the reinforcing structure.

Later designs used an opaque backside filament in the dual layer design, allowing for higher precure energy and better lock-on of the resin to the reinforcing structure, while maintaining adequate backside leakage. This design effectively decoupled the tradeoff between adequate resin lock-on and adequate backside leakage in the prior art. Examples of such improvements in this type of belt are illustrated by U.S. patent application Ser. No. 07/872,470 filed Jun. 15, 1992 in the names of Trokhan et al., Issue Batch No. V73. Yet other ways to obtain a backside texture are illustrated by U.S. Pat. Nos. 5,098,522, issued Mar. 24, 1992 to Smurkoski et al.; 5,260,171, issued Nov. 9, 1993 to Smurkoski et al.; and 5,275,700, issued Jan. 4, 1994 to Trokhan, which patents and application are incorporated herein by reference for the purpose of showing how to obtain a backside texture on a patterned resin and reinforcing structure through-air-drying belt.

As such resinous framework and reinforcing structure belts were used to make tissue products, such as the commercially successful Charmin Ultra noted above, new issues arose. For example, one problem in tissue making is the formation of small pinholes in the deflected areas of the web. It has recently been learned that pinholes are strongly related to the weave configuration of the reinforcing element of the patterned resinous through-air-drying belt.

Standard patterned resinous through-air-drying belts maximize the projected open area, so that airflow therethrough is not reduced or unduly blocked. Patterned resinous through-air-drying belts common in the prior art use a dual layer design reinforcing element having vertically stacked warps. Generally, the wisdom has been to use relatively large diameter yarns, to increase belt life. Belt life is important not only because of the cost of the belts, but more importantly due to the expensive downtime incurred when a worn belt must be removed and a new belt installed. Unfortunately, larger diameter yarns require larger holes therebetween in order to accommodate the weave. The larger holes permit short fibers, such as Eucalyptus, to be pulled through the belt and thereby create pinholes. Unfortunately, short fibers, such as Eucalyptus, are heavily consumer preferred due to the softness they create in the resulting cellulosic fibrous structure.

This problem can be overcome by adding more yarns per inch woven in the same pattern. However, this "solution" reduces the open area available for air flow. If the yarns are made smaller to reopen the open area, the flexural rigidity and integrity of the reinforcing structure of the belt is compromised and the belt life is thereby reduced. Accordingly, the prior art required a trade-off between the necessary open area (for airflow) and fiber diameter (for pinholing and belt life).

One attempt to achieve both good fiber support, and the flexural rigidity and belt integrity necessary to achieve a viable belt life was to use a combination of large and small machine direction yarns. The large diameter yarns are disposed on the reinforcing layer for fabric durability, and the smaller diameter machine direction yarns are stacked on the web facing layer for fiber support and pinhole reduction. Furthermore, a small machine direction yarn in the first layer may be placed between large machine direction yarns of the second layer for added fiber support. This attempt still did not produce wholly satisfactory results in pinhole reduction efforts due to a lack of planarity. Accordingly, it is necessary to turn to yet a different parameter than those utilized above to decouple the trade-offs required by the prior art.

One attempt to find a different parameter was to add a machine direction yarn between each pair of stacked machine direction yarns, so that a single cross-machine direction yarn tied together stacked machine direction yarns. However, one problem this attempt encountered was the machine direction yarns not supported immediately thereunder by another yarn tended to sag—increasing pinholing. Additionally, the cross-machine direction yarns which tied the two layers together went from the extreme of one layer to the extreme of the other layer. This deviation from planarity also increased pinholing.

A second attempt increased the tie frequency of the cross-machine direction yarns from a six shed to a four shed. However, similar problems occurred—including sagging of the machine direction yarns of the upper layer which were stacked with the machine direction yarns of the lower layer, due to either inadequate support from the other yarns, or due to being pulled towards the second layer by the cross-machine direction yarns.

These approaches were not successful. Clearly yet another approach was necessary.

Likewise, the weave pattern must be applicable to press felts. Press felts dewater a cellulosic web by compaction. Suitable press felts may be made in accordance with U.S. Pat. No. 3,652,389 issued Mar. 28, 1972 to Helland; 4,752,519 issued Jun. 21, 1988 to Boyer et al.; and 4,922,627 issued May 8, 1990 to Romero Hernandez, which patents are incorporated herein by reference for the purpose of showing how to make a press felt according to the present invention.

The necessary approach recognizes that pinholing in a through-air-drying belt and fiber loss in a forming wire are unexpectedly related to the yarns that support the fibers—rather than the open spaces between the yarns. The web facing yarns must remain close to the top plane of the first layer, to provide adequate fiber support. Still, the weave pattern must accommodate large diameter yarns in order to provide adequate belt life.

Accordingly, it is an object of this invention to provide a forming wire which reduces fiber loss and non-uniform fiber distribution in specific areas of the resulting product. It is another object of this invention to provide a patterned resinous through-air-drying papermaking belt which overcomes the prior art trade-off of belt life and reduced pinholing. Additionally, it is an object of this invention to provide an improved patterned resinous through-air-drying belt having sufficient open area to efficiently use during manufacturing. It is also an object of this invention to provide a patterned resinous through-air-drying belt which produces an aesthetically acceptable consumer product comprising a cellulosic fibrous structure.

SUMMARY OF THE INVENTION

The invention comprises a papermaking belt comprising a reinforcing structure. The reinforcing structure has a web facing first layer of interwoven machine direction yarns and cross-machine direction yarns. The yarns of the first layer have a yarn diameter and are interwoven in a weave comprising knuckles. The knuckles define a web facing top plane. Each yarn of the first layer has a top dead center longitude. The top dead center longitude remains within 1.5 yarn diameters of the top plane. The reinforcing structure also comprises a machine facing second layer of interwoven machine direction and cross-machine direction yarns, which are interwoven into a weave. The first layer and second layer are tied together by a plurality of tie yarns which do not remain within 1.5 yarn diameters of the top plane. The reinforcing structure has a thickness at least 2.5 times as great as the yarn diameter. The belt further comprises a pattern layer extending outwardly from the first layer and into the second layer. The pattern layer provides a web contacting surface facing outwardly of the first layer. The pattern layer connects the first and second layers, stabilizing them relative to each other during the manufacture of cellulosic fibrous structures.

DETAILED DESCRIPTION OF THE INVENTION

Figure 1:
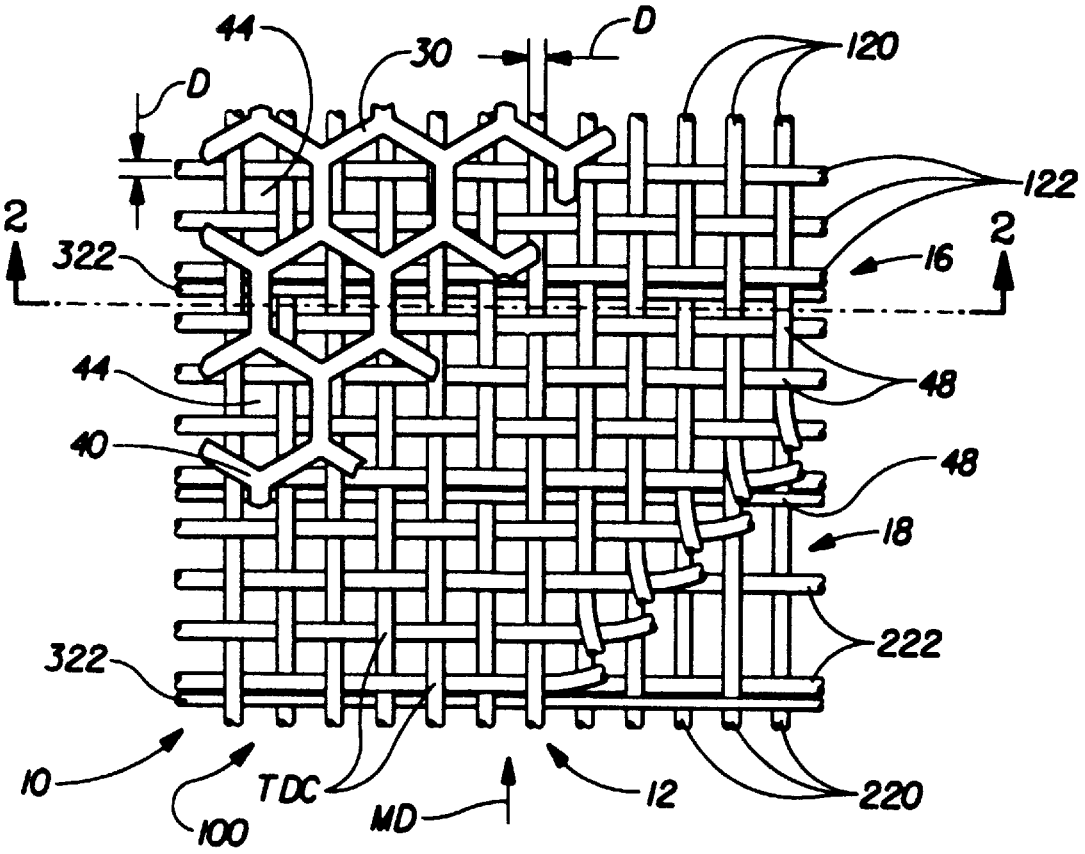
FIG. 1 is a top plan view shown partially in cutaway of a belt according to the present invention having cross-machine direction adjunct tie yarns.
Figure 2:
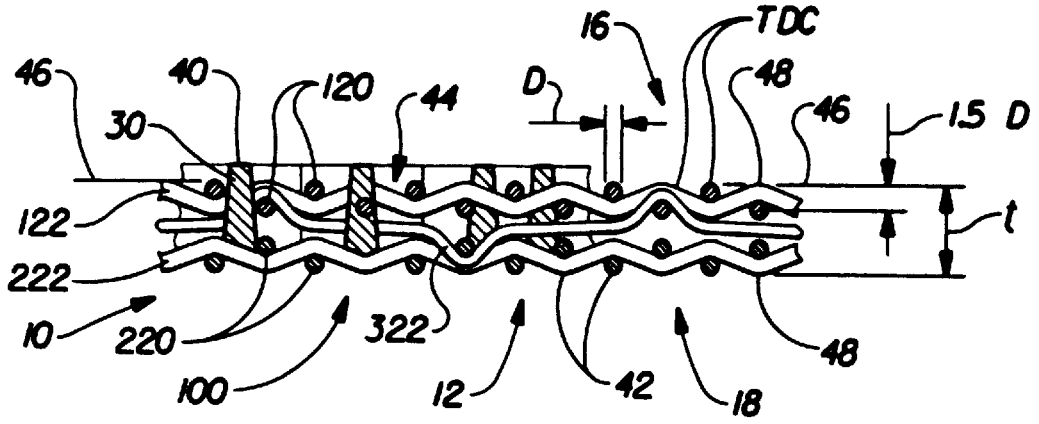
FIG. 2 is a vertical sectional view taken along line 2—2 of FIG. 1 and having the pattern layer partially removed for clarity.

Referring to FIGS. 1 and 2, the belt 10 of the present invention is preferably an endless belt and may receive cellulosic fibers discharged from a headbox or carry a web of cellulosic fibers to a drying apparatus, typically a heated drum, such as a Yankee drying drum (not shown). Thus, the endless belt 10 may either be executed as a forming wire, a press felt, or as a through-air-drying belt, as needed.

The papermaking belt 10 of the present invention, in either such execution, comprises two primary elements: a reinforcing structure 12 and optional pattern layer 30. The reinforcing structure 12 is further comprised of at least two layers, a web facing first layer 16 and a machine facing second layer 18. Each layer 16, 18 of the reinforcing structure 12 is further comprised of interwoven machine direction yarns 120, 220 and cross-machine direction yarns 122, 222. The reinforcing structure 12 further comprises tie yarns 320, 322 interwoven with the respective yarns 100 of the web facing layer 16 and the machine facing layer 18.

As used herein, "yarns 100" is generic to and inclusive of machine direction yarns 120, cross-machine direction yarns 122 of the first layer 16, as well as machine direction yarns 220 and cross-machine direction yarns 222 of the second layer 18.

The second primary element of the belt 10 is the pattern layer 30. The pattern layer 30 is cast from a resin onto the top of the first layer 16 of the reinforcing structure 12. The pattern layer 30 penetrates the reinforcing structure 12 and is cured into any desired binary pattern by irradiating liquid resin with actinic radiation through a binary mask having opaque sections and transparent sections.

The belt 10 has two opposed surfaces, a web contacting surface 40 disposed on the outwardly facing surface of the pattern layer 30 and an opposed backside 42. The backside 42 of the belt 10 contacts the machinery used during the papermaking operation. Such machinery (not illustrated) includes a vacuum pickup shoe, vacuum box, various rollers, etc.

The belt 10 may further comprise conduits 44 extending from and in fluid communication with the web contacting surface 40 of the belt 10 to the backside 42 of the belt 10. The conduits 44 allow deflection of the cellulosic fibers normal to the plane of the belt 10 during the papermaking operation.

Figure 4A:
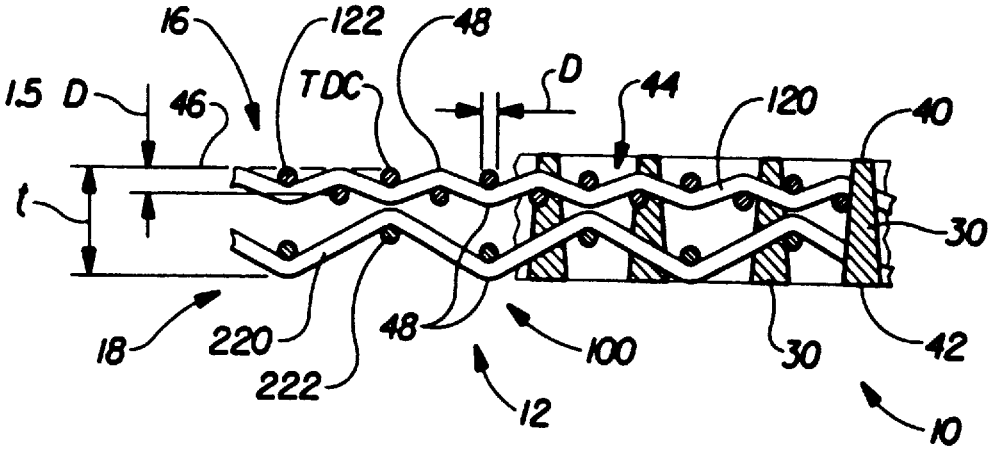
FIGS. 4A and 4B are vertical sectional views taken along line 4A—4A and 4B—4B of FIG. 3 and having the pattern layers partially removed for clarity.
Figure 4B:
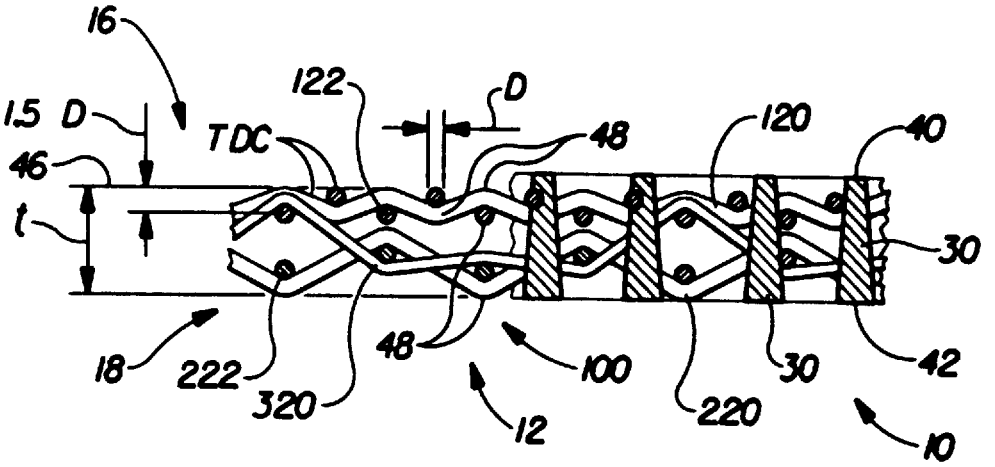

The conduits 44 may be discrete, as shown, if an essentially continuous pattern layer 30 is selected. Alternatively, the pattern layer 30 can be discrete and the conduits 44 may be essentially continuous. Such an arrangement is easily envisioned by one skilled in the art as generally opposite that illustrated in FIG. 1. Such an arrangement, having a discrete pattern layer 30 and an essentially continuous conduit 44, is illustrated in FIG. 4 of the aforementioned U.S. Pat. No. 4,514,345 issued to Johnson et al. and incorporated herein by reference. Of course, it will be recognized by one skilled in the art that any combination of discrete and continuous patterns may be selected as well.

The pattern layer 30 is cast from photosensitive resin, as described above and in the aforementioned patents incorporated herein by reference. The preferred method for applying the photosensitive resin forming the pattern layer 30 to the reinforcing structure 12 in the desired pattern is to coat the reinforcing layer with the photosensitive resin in a liquid form. Actinic radiation, having an activating wavelength matched to the cure of the resin, illuminates the liquid photosensitive resin through a mask having transparent and opaque regions. The actinic radiation passes through the transparent regions and cures the resin therebelow into the desired pattern. The liquid resin shielded by the opaque regions of the mask is not cured and is washed away, leaving the conduits 44 in the pattern layer 30.

It has been found, as identified in the aforementioned U.S. patent application Ser. No. 07/872,470 filed in the name of Trokhan et al. and incorporated herein by reference, that opaque machine direction yarns 220 or cross-machine direction yarns 222 may be utilized to mask the portion of the reinforcing structure 12 between such machine direction yarns 220 and cross-machine direction yarns 222 and the backside 42 of the belt 10 to create a backside texture. The aforementioned application is incorporated herein by reference for the purpose of illustrating how to incorporate such opaque yarns 220, 222 into a reinforcing structure 12 according to the present invention. The yarns 220, 222 of the second layer 18 may be made opaque by coating the outsides of such yarns 220, 222, adding fillers such as carbon black or titanium dioxide, etc.

The pattern layer 30 extends from the backside 42 of the second layer 18 of the reinforcing structure 12, outwardly from and beyond the first layer 16 of the reinforcing structure 12. Of course, as discussed more fully below, not all of the pattern layer 30 extends to the outermost plane of the backside 42 of the belt 10. Instead, some portions of the pattern layer 30 do not extend below particular yarns 220, 222 of the second layer 18 of the reinforcing structure 12. The pattern layer 30 also extends beyond and outwardly from the top dead center longitude TDC of the first layer 16 a distance of about 0.002 inches (0.05 millimeter) to about 0.050 inches (1.3 millimeters). The dimension of the pattern layer 30 perpendicular to and beyond the first layer 16 generally increases as the pattern becomes coarser. The distance the pattern layer 30 extends from the top dead center longitude TDC of the first layer 16 is measured from the plane 46 in the first layer 16, furthest from the backside 42 of the second layer 18.

The term "machine direction" refers to that direction which is parallel to the principal flow of the paper web through the papermaking apparatus. The "cross-machine direction" is perpendicular to the machine direction and lies within the plane of the belt 10. A "knuckle" is the intersection of a machine direction yarn 120, 220 and a cross-machine direction yarn 122, 222. The "shed" is the minimum number of yarns 100 necessary to make a repeating unit in the principal direction of a yarn 100 under consideration.

The machine direction and cross-machine direction yarns 120, 122 are interwoven into a web facing first layer 16. Such a first layer 16 may have a one-over, one-under square weave, or any other weave which has a minimal deviation from the top plane 46. Preferably the machine direction and cross-machine direction yarns 120, 122 comprising the first layer 16 are substantially transparent to actinic radiation which is used to cure the pattern layer 30. Such yarns 120, 122 are considered to be substantially transparent if actinic radiation can pass through the greatest cross-sectional dimension of the yarns 120, 122 in a direction generally perpendicular to the plane of the belt 10 and still sufficiently cure photosensitive resin therebelow.

The machine direction yarns 220 and cross-machine direction yarns 222 are also interwoven into a machine facing second layer 18. The yarns 220, 222, particularly the cross-machine direction yarns 222, of the machine facing second layer 18 are preferably larger than the yarns 120, 122 of the first layer 16, to improve seam strength. This result may be accomplished by providing cross-machine direction yarns 222 of the second layer 18 which are larger in diameter than the machine direction yarns 120 of the first layer—if yarns 100 having a round cross section are utilized.

The web facing first layer 16 is woven so that the top dead center longitude TDC of each yarn 120, 122 of the first layer 16 that is in the top plane 46 does not extend more than 1.5 yarn diameters D, and preferably not more than 1.0 yarn diameters D away from the top plane 46 at any position, and remains within 1.0 or 1.5 yarn diameters D of the top plane 46 at all positions, unless such yarn 120, 122 is a tie yarn 320, 322. The yarn diameter D is based on the diameter(s) of the yarns 120, 122 of the first layer 16. If yarns 120, 122 having different diameters are utilized, the yarn diameter D is the diameter of the largest yarn 120, 122 of the first layer 16. If yarns 120, 122 having a non-round cross section are utilized, the yarn diameter D is considered to be the maximum dimension through such yarn 120, 122 taken perpendicular to the plane of the belt 10. The top dead center longitude TDC of a yarn 100 is that line parallel to the major axis of the yarn 100 and disposed on the circumference of the yarn 100 at the position closest to top plane 46.

The top dead center longitudes TDC of the yarns 120, 122 remain within 1.0 diameters D of the top plane 46 if a monoplanar weave is utilized. The top dead center longitudes TDC of the yarns 120, 122 remain within 1.5 yarn diameters D if a weave having sub-top surface knuckles is utilized.

To determine whether or not the top dead center longitudes TDC of the yarns 120, 122 remains within 1.0 or 1.5 yarn diameters D of the top plane 46 an imaginary cutting plane 1.0 or 1.5 yarn diameters D is drawn parallel to the top plane 46 (and disposed towards the backside 42 of the reinforcing structure 12).

The top dead center longitudes TDC of yarns 120, 122 which form knuckles 48 defining the top plane 46 are considered to remain within 1.0 or 1.5 yarn diameters D of the top plane 46 if such top dead center longitudes TDC do not intercept the respective imaginary cutting plane.

In accordance with the present invention, the yarns 120, 122 of the first layer 16 may be interwoven in a weave of N over and N under, where N equals a positive integer, 1, 2, 3 . . . . A preferred weave of N over and N under is a square weave having N equal to 1.

Another preferred weave is an N over, 1 under weave, etc., so long as the yarns 120, 122 of the first layer 16 cross over the respective interwoven yarns 122, 120 of the first layer 16, such that such yarns 120, 122 are on the top dead center longitude TDC of the first layer 16, more than on the backside of the first layer 16. For N greater than 1, preferably the N over yarns 120, 122 are cross-machine direction yarns 122, in order to maximize fiber support.

Also, the reinforcing structure 12 of the belt 10 according to the present invention has a thickness t at least 2.5 times as great as one yarn diameter D, as defined above, and more preferably at least 3.0 times as great as one yarn diameter D. Such a thickness t is important in providing sufficient belt 10 rigidity, so that belt 10 life is not unduly compromised.

The thickness t of the reinforcing structure 12 is measured using an Emveco Model 210A digital micrometer made by the Emveco Company of Newburg, Oreg., or similar apparatus, using a 3.0 pounds per square inch loading applied through a round 0.875 inch diameter foot. The reinforcing structure 12 may be loaded up to a maximum of 20 pounds per lineal inch in the machine direction while tested for thickness. The reinforcing structure 12 must be maintained at 50–100° F. during testing.

The machine direction and cross-machine direction yarns 220, 222 comprising the second layer 18 may be woven in any suitable shed and pattern, such as a square weave, as shown, or a twill or broken twill weave. If desired, the second layer 18 may have a cross-machine direction yarn 222 in every other position, corresponding to alternating cross-machine direction yarns 122 of the first layer. It is more important that the first layer 16 have multiple and more closely spaced cross-machine direction yarns 122, to provide sufficient fiber support. Generally, the machine direction yarns 220 of the second layer 18 occur with a frequency coincident that of the machine direction yarns 120 of the first layer 16, in order to preserve seam strength and improve belt rigidity.

Adjunct tie yarns 320, 322 may be interposed between and interwoven with the first layer 16 and the second layer 18. The adjunct tie yarns 320, 322 may be machine direction tie yarns 320 which are interwoven with respective cross-machine direction yarns 122, 222 of the first and second layers 16, 18, or cross-machine direction tie yarns 322, which are interwoven with the respective machine direction yarns 120, 220 of the first and second layers 16, 18. As used herein, tie yarns 320, 322 are considered to be "adjunct" if such tie yarns 320, 322 do not comprise a yarn 100 inherent in the weave selected for either of the first or second layers 16, 18, but instead is in addition to, and may even disrupt, the weave of the first or second layers 16, 18.

Preferably the adjunct tie yarns 320, 322 are smaller in diameter than the yarns 100 of the first and second layers 16, 18, so such tie yarns 320, 322 do not unduly reduce the projected open area of the belt 10.

A preferred weave pattern for the adjunct tie yarns 320, 322 has the least number of tie points necessary to stabilize the first layer 16 relative to the second layer 18. The tie yarns 324 are preferably oriented in the cross-machine direction because this arrangement is generally easier to weave.

Contrary to the types of weave patterns dictated by the prior art, the stabilizing effect of the pattern layer 30 minimizes the number of tie yarns 320, 322 necessary to engage the first layer 16 and the second layer 18. This is because the pattern layer 30 stabilizes the first layer 16 relative to the second layer 18 once casting is complete and throughout the paper manufacturing process. Accordingly, smaller and fewer adjunct tie yarns 320, 322 may be selected, than the yarns 100 used to make the first or second layers 16, 18.

Adjunct tie yarns 320, 322 having relatively fewer and smaller yarns 20, 22 are desirable, because the adjunct tie yarns 320, 322, of course, reduce the projected open area of the belt 10. It is desirable that the entire reinforcing structure 12 have a large projected open area. The large open area is important in providing a sufficient path for the air flow therethrough to occur. If limiting orifice drying, such as is beneficially described in U.S. Pat. No. 5,274,930 issued Jan. 4, 1994 to Ensign et al. is desired, it becomes even more important that the belt 10 has sufficient open area.

More importantly, the reinforcing structure 12 according to the present invention must allow sufficient air flow perpendicular to the plane of the reinforcing structure 12. The reinforcing structure 12 preferably has an air permeability of at least 900 standard cubic feet per minute per square foot, preferably at least 1,000 standard cubic feet per minute per square foot, and more preferably at least 1,100 standard cubic feet per minute per square foot. Of course the pattern layer 30 will reduce the air permeability of the belt 10 according to the particular pattern selected. The air permeability of a reinforcing structure 12 is measured under a tension of 15 pounds per linear inch using a Valmet Permeability Measuring Device from the Valmet Company of Finland at a differential pressure of 100 Pascals. If any portion of the reinforcing structure 12 meets the aforementioned air permeability limitations, the entire reinforcing structure 12 is considered to meet these limitations.

Figure 3:
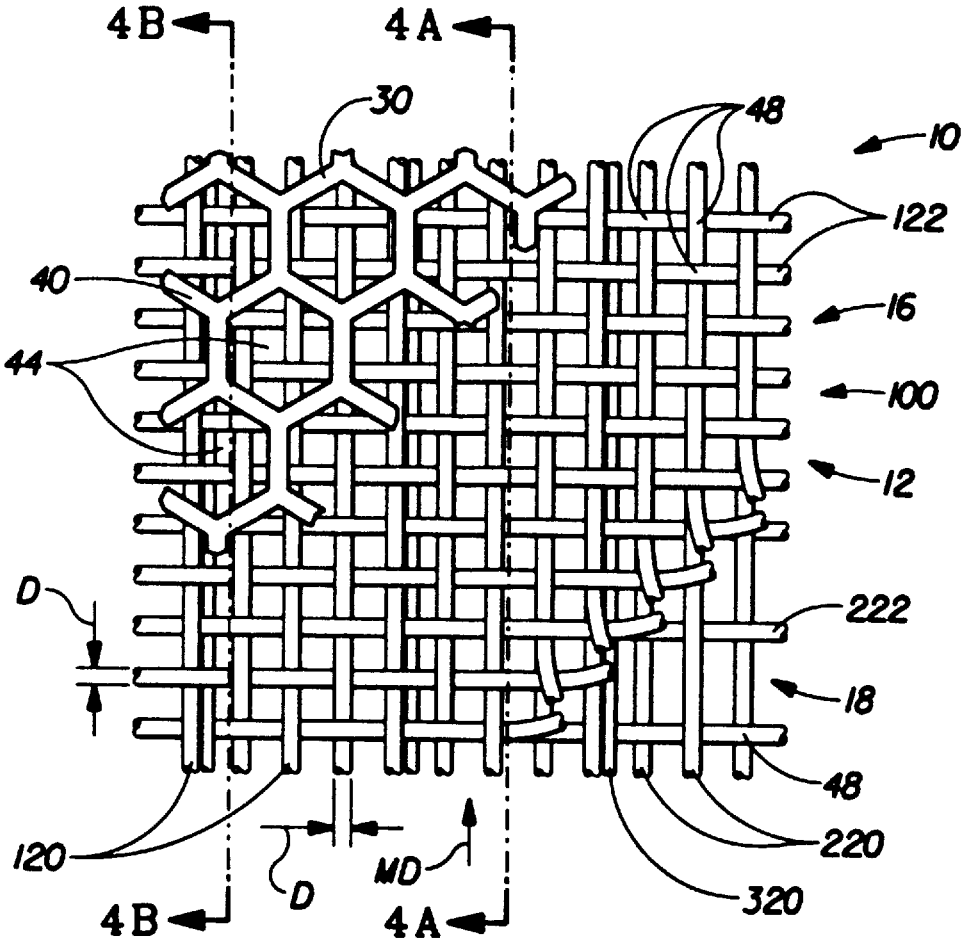
FIG. 3 is a top plan view shown partially in cutaway of a belt according to the present invention having machine direction integral tie yarns in the second layer.

Referring to FIGS. 3 and 4, if desired, the adjunct tie yarns 320, 322 may be omitted. Instead of adjunct tie yarns 320, 322, a plurality of machine direction yarns or cross-machine direction yarns 320, 322 of the second layer 18 may be interwoven with respective cross-machine direction or machine direction yarns 122, 120 of the first layer 16. These interwoven yarns 320, 322 which do not remain in the plane of the second layer 18 are hereinafter referred to as "integral tie yarns" 320, 322 because these integral tie yarns 320, 322 which join the first and second layers 16, 18, and stabilize the second layer 18 relative to the first layer 16 are inherently found in the weave of at least one such layer 16, 18. The yarns 100 which remain within the plane of the first or second layer 16, 18 are referred to as non-tie yarns 100.

Preferably the integral tie yarns 320, 322 of the second layer 18 which are interwoven with the respective cross-machine direction or machine direction yarns 122, 120 of the first layer 16 are machine direction tie yarns 320, to maximize seam strength. However, arrangements having cross-machine direction integral tie yarns 322 may be utilized.

In an alternative embodiment (not shown), the integral tie yarns 320, 322 may extend from the first layer 16 and be interwoven with the respective machine direction or cross-machine direction yarns 220, 222 of the second layer 18. This embodiment may be easily envisioned by turning FIG. 4 upside down.

Figure 5:
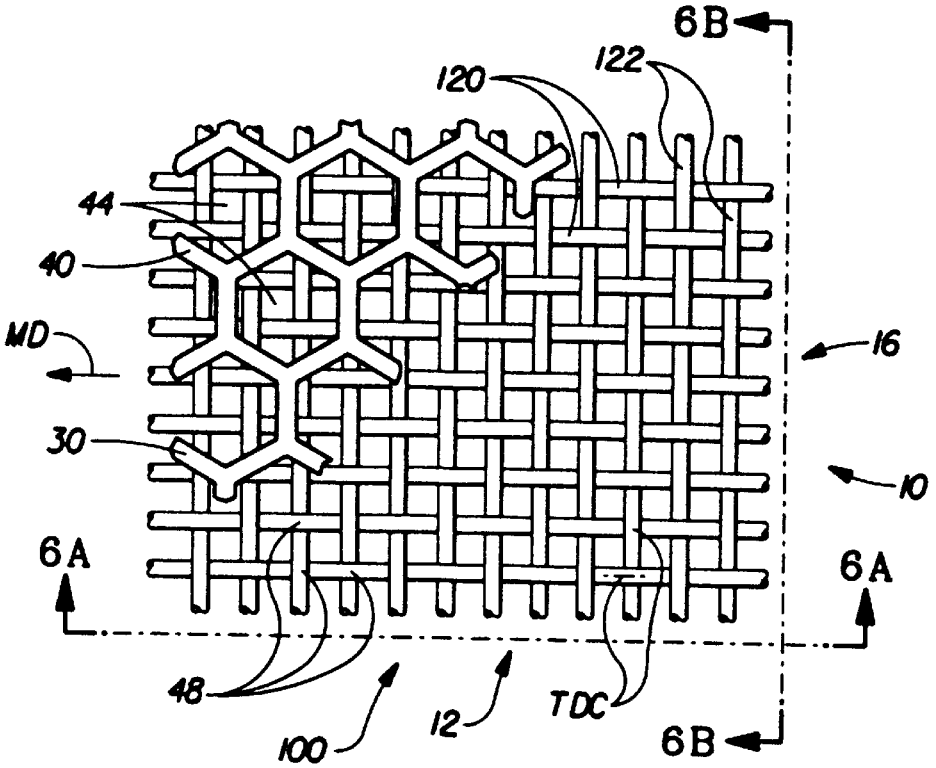
FIG. 5 is a top plan view shown partially in cutaway of a belt according to the present invention having machine direction integral tie yarns in both the first and second layers.
Figure 6A:
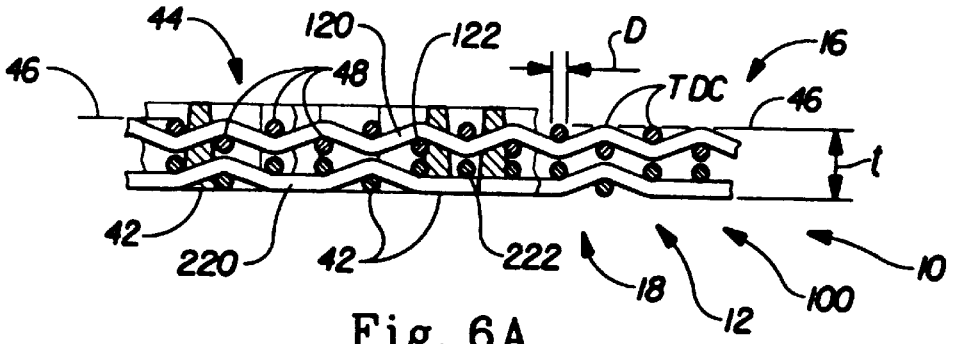
FIGS. 6A and 6B are vertical sectional views taken along line 6A—6A and 6B—6B of FIG. 5 and having the pattern layers partially removed for clarity.
Figure 6B:
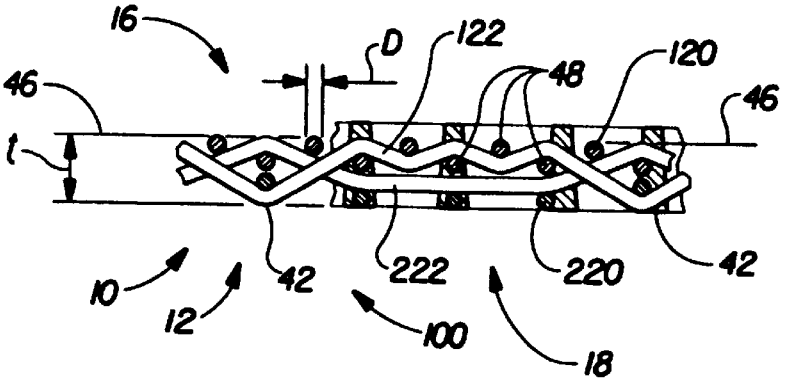

Referring to FIGS. 5 and 6, the integral tie yarns 320, 324 may emanate from both the first and second layers 16, 18, in a combination of the two foregoing teachings. Of course, one skilled in the art will recognize this arrangement may be used in conjunction with adjunct tie yarns 320, 322 as well.

While other embodiments of the invention are feasible, given the various combinations and permutations of the foregoing teachings, it is not intended to thereby limit the present invention to only that which is shown and described above.

What is claimed is:

1. A papermaking belt comprising:

a web facing first layer of interwoven machine direction yarns and cross-machine direction yarns, said machine direction and cross-machine direction yarns of said first layer having a yarn diameter and being interwoven in a weave comprising knuckles, said knuckles defining a web facing top plane, each yarn of said first layer having a top dead center longitude, said top dead center longitude remaining within 1.5 yarn diameters of said top plane; and a machine facing second layer of interwoven machine direction yarns and cross-machine direction yarns, said machine direction and cross-machine direction yarns of said second layer being interwoven in a weave, said first layer and said second layer being tied together by a plurality of tie yarns which do not remain within 1.5 yarn diameters of said top plane, wherein said reinforcing structure has a thickness at least 2.5 times as great as said yarn diameter.

2. A papermaking belt comprising:

a web facing first layer of interwoven machine direction yarns and cross-machine direction yarns, said machine direction and cross-machine direction yarns of said first layer having a yarn diameter and being interwoven in a weave comprising knuckles, said knuckles defining a web facing top plane, each yarn of said first layer having a top dead center longitude, said top dead center longitude remaining within 1.5 yarn diameters of said top plane;

a machine facing second layer of interwoven machine direction yarns and cross-machine direction yarns, said machine direction and cross-machine direction yarns of said second layer being interwoven in a weave, said first layer and said second layer being tied together by a plurality of tie yarns which do not remain within 1.5 yarn diameters of said top plane; and adjunct cross-machine direction or adjunct machine direction tie yarns interwoven with respective machine direction yarns or cross-machine direction yarns of said web facing layer and said machine facing layer to tie said first layer and said second layer relative to one another, said adjunct tie yarns not remaining within one yarn diameter of said top plane, wherein said reinforcing structure has a thickness at least 2.5 times as great as said yarn diameter.

3. A papermaking belt comprising:

a web facing first layer of interwoven machine direction yarns and cross-machine direction yarns, said machine direction and cross-machine direction yarns of said first layer having a yarn diameter and being interwoven in a weave comprising knuckles, said knuckles defining a web facing top plane, each yarn of said first layer having a top dead center longitude, said top dead center longitude remaining within 1.5 yarn diameters of said top plane;

a machine facing second layer of interwoven machine direction yarns and cross-machine direction yarns, said machine direction and cross-machine direction yarns of said second layer being interwoven in a weave, said first layer and said second layer being tied together by a plurality of tie yarns which do not remain within one yarn diameter of said top plane, and wherein a plurality of said machine direction yarns or said cross-machine direction yarns of said second layer are interwoven with respective cross-machine direction yarns or machine direction yarns of said first layer as integral tie yarns to tie said first layer and said second layer relative to one another, said integral tie yarns not remaining within 1.5 yarn diameters of said top plane, wherein said reinforcing structure has a thickness at least 2.5 times as great as said yarn diameter.

4. A papermaking belt according to claim 2 wherein said machine direction yarns and said cross-machine direction yarns of said first layer are generally orthogonal and thereby form knuckles, wherein less than fifteen percent of said knuckles are interwoven with said plurality of yarns extending from said second layer.

5. A papermaking belt according to claim 3 wherein said machine direction yarns and said cross-machine direction yarns of said first layer are generally orthogonal and thereby form knuckles, wherein less than fifteen percent of said knuckles are interwoven with said plurality of yarns extending from said second layer.

6. A papermaking belt according to claim 4 wherein said machine direction yarns and said cross-machine direction yarns of said first layer are generally orthogonal and thereby form knuckles, wherein one percent to five percent of said knuckles are interwoven with said plurality of yarns extending from said second layer.

7. A papermaking belt according to claim 5 wherein said machine direction yarns and said cross-machine direction yarns of said first layer are generally orthogonal and thereby form knuckles, wherein one percent to five percent of said knuckles are interwoven with said plurality of yarns extending from said second layer.

8. A papermaking belt according to claim 6 wherein said yarns of said first layer are interwoven in an N over, 1 under weave.

9. A papermaking belt according to claim 7 wherein said yarns of said first layer are interwoven in an N over, 1 under weave.

10. A papermaking belt according to claim 8 wherein said N over yarns are cross-machine direction yarns.

11. A papermaking belt according to claim 9 wherein said N over yarns are cross-machine direction yarns.

12. A papermaking belt according to claim 11 wherein N equals 1.

13. A papermaking belt according to claim 12 wherein N equals 1.

14. A papermaking belt according to claim 2 wherein said papermaking belt is a forming wire.

15. A papermaking belt according to claim 3 wherein said papermaking belt is a forming wire.

16. A papermaking belt according to claim 2 wherein said papermaking belt is a through-air-drying belt.

17. A papermaking belt according to claim 3 wherein said papermaking belt is a through-air-drying belt.

18. A papermaking belt according to claim 6 wherein said papermaking belt has an air permeability of at least 900 standard cubic feet per minute per square foot.

19. A papermaking belt according to claim 7 wherein said papermaking belt has an air permeability of at least 900 standard cubic feet per minute per square foot.

* * * * *